US007487784B2

(12) United States Patent
Gueret

(10) Patent No.: US 7,487,784 B2
(45) **Date of Patent: *Feb. 10, 2009**

(54) APPLICATOR INCLUDING A STEM CONNECTED TO A HANDLE MEMBER VIA A HINGE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 865 days.

This patent is subject to a terminal disclaimer.

(21) Appl. No.: 10/456,964

(22) Filed: Jun. 9, 2003

(65) Prior Publication Data

US 2004/0035437 A1 Feb. 26, 2004

Related U.S. Application Data

(60) Provisional application No. 60/388,309, filed on Jun. 14, 2002, provisional application No. 60/388,308, filed on Jun. 14, 2002.

(30) Foreign Application Priority Data

Jun. 7, 2002 (FR) ..... 02 07060
Jun. 7, 2002 (FR) ..... 02 07061

(51) Int. Cl.
*A45D 40/26* (2006.01)

(52) U.S. Cl. ..... 132/218

(58) Field of Classification Search ..... 132/218, 132/216, 217, 320; 401/118–130; 15/206, 15/207, 171, 172, 185, 144.1
See application file for complete search history.

(56) References Cited

U.S. PATENT DOCUMENTS 1,905,399 A * 4/1933 Wagner ..... 15/160
2,173,959 A 2/1939 Britt
2,216,023 A * 9/1940 Smith ..... 15/144.1
2,666,222 A * 1/1954 Gordon ..... 15/185
2,792,581 A * 5/1957 Woyton ..... 15/144.1
3,185,291 A 5/1965 Lerner
3,741,667 A 6/1973 Cesari
4,165,755 A 8/1979 Cassai
4,370,989 A 2/1983 Taylor
4,396,028 A 8/1983 Waggoner
4,396,029 A 8/1983 Anderson
4,428,388 A 1/1984 Cassai et al.
4,898,193 A 2/1990 Gueret
5,071,277 A * 12/1991 Braun ..... 401/126
5,328,282 A 7/1994 Charrier et al.
5,435,328 A 7/1995 Grohoske
5,542,439 A 8/1996 Gueret (Continued)

FOREIGN PATENT DOCUMENTS

DE 101 02 284 A1 11/2002

(Continued)

*Primary Examiner*—Robyn Doan
(74) *Attorney, Agent, or Firm*—Oliff & Berridge, PLC

(57) ABSTRACT

The present invention provides an applicator comprising:

a handle member;

a stem connected via a hinge to the handle member; and an applicator element disposed at a first end of the stem and configured to apply makeup on keratinous fibers;

the stem including a maneuverable portion enabling the direction in which it points relative to the handle member to be modified, the maneuverable portion extending at least in part between the hinge and a second end of the stem opposite from its first end.

47 Claims, 5 Drawing Sheets

U.S. PATENT DOCUMENTS

| | | | | |
|---|---|---|---|---|
| 5,758,382 | A | 6/1998 | Maekawa et al. | |
| 5,853,011 | A | 12/1998 | Gueret | |
| 5,860,432 | A | 1/1999 | Gueret | |
| 5,876,138 | A | 3/1999 | Gueret | |
| 5,891,906 | A | 4/1999 | Driedger et al. | |
| 5,894,847 | A | 4/1999 | Gueret | |
| 5,906,214 | A | 5/1999 | Gueret | |
| 5,918,994 | A | 7/1999 | Gueret | |
| 5,934,292 | A | 8/1999 | Gueret | |
| 5,937,870 | A | 8/1999 | Gueret | |
| 6,026,823 | A * | 2/2000 | Gueret | 132/218 |
| 6,050,273 | A | 4/2000 | Lhuisset | |
| 6,220,254 | B1 | 4/2001 | Gueret | |
| 6,237,609 | B1 | 5/2001 | Vasas | |
| 6,532,967 | B1 | 3/2003 | Dumler | |
| 6,715,952 | B1 * | 4/2004 | Aiken et al. | 401/282 |
| 6,772,770 | B1 | 8/2004 | Williams, Sr. | |
| 2002/0020426 | A1 | 2/2002 | Gueret | |

FOREIGN PATENT DOCUMENTS

| | | | |
|---|---|---|---|
| EP | 0 791 307 | A1 | 8/1997 |
| EP | 1 053 695 | A2 | 11/2000 |
| FR | 1395217 | | 7/1965 |
| FR | 2701196 | | 2/1996 |
| FR | 2 798 267 | A1 | 3/2001 |
| JP | A 57-57510 | | 4/1982 |
| JP | U 58-86017 | | 6/1983 |
| JP | U 61-174515 | | 10/1986 |
| JP | U 1-153115 | | 10/1989 |
| JP | U 05-01411 | | 1/1993 |
| JP | A 2001-008727 | | 1/2001 |
| JP | A 2002-085150 | | 3/2002 |
| WO | WO 93/16617 | | 9/1993 |
| WO | WO 01/70589 | | 11/2001 |

* cited by examiner

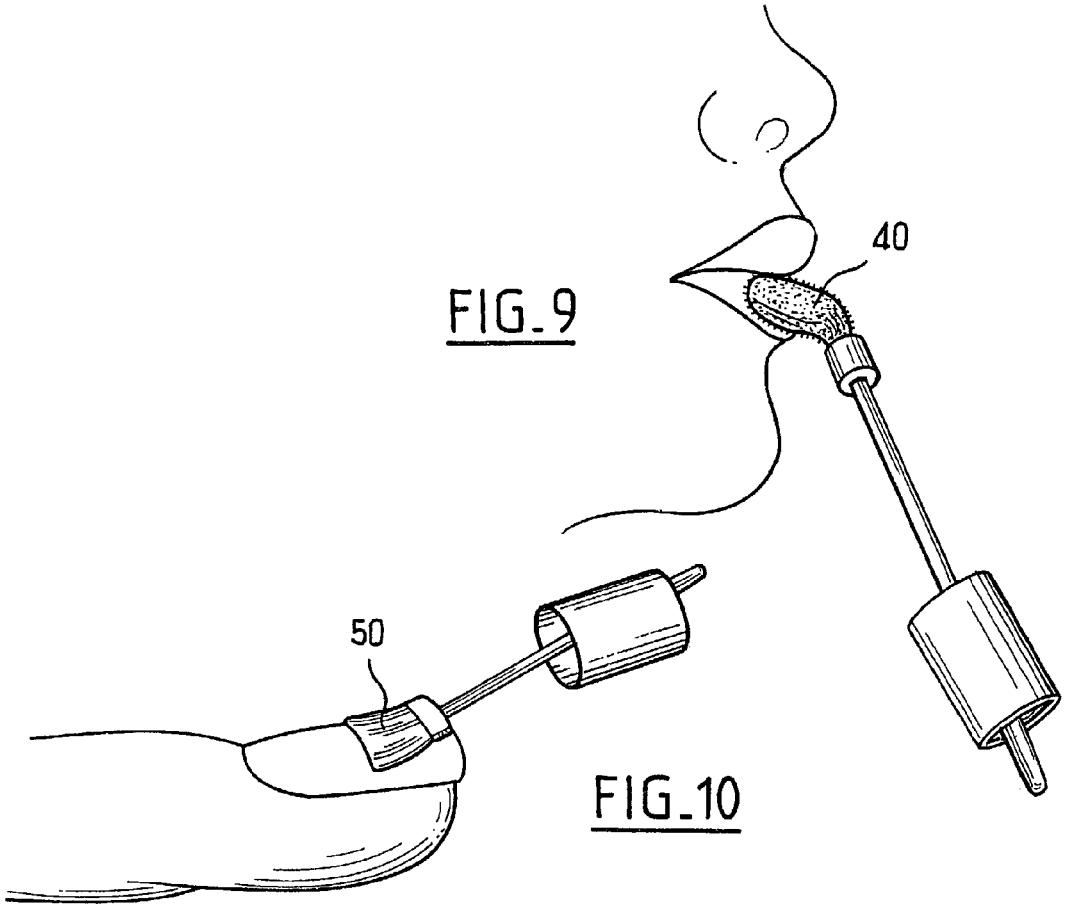
FIG_9
FIG_10
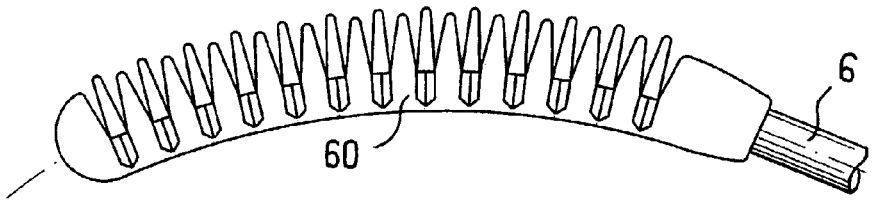
FIG_11
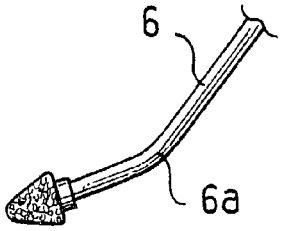
FIG_12
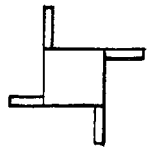
FIG_12A

APPLICATOR INCLUDING A STEM CONNECTED TO A HANDLE MEMBER VIA A HINGE

CROSS REFERENCE TO RELATED APPLICATIONS

The present application claims the benefit of French patent application number 02-07060, filed Jun. 7, 2002; French patent application number 02-07061, filed Jun.7, 2002; U.S. provisional patent application No. 60/388,308, filed Jun. 14, 2002; and U.S. provisional patent application No. 60/388,309, filed Jun. 14, 2002, the disclosures of which are hereby incorporated by reference.

BACKGROUND OF THE INVENTION (i) Field of the Invention

The present invention relates to applicators comprising a handle member, a stem connected via a hinge to the handle member, and an applicator element disposed at one end of the stem.

(ii) Description of Related Art

Such applicators, which are suitable for applying a cosmetic, are described in U.S. Pat. No. 6,026,823.

Other applicators are described in: U.S. Pat. No. 5,328,282, U.S. Pat. No. 2,173,959, U.S. Pat. No. 4,396,029, U.S. Pat. No. 5,435,328, FR 2 701 196, U.S. Pat. No. 4,165,755, FR 1 395 217, U.S. Pat. No. 4,428,388, U.S. Pat. No. 3,185,291, and U.S. Pat. No. 4,370,989.

Amongst the above-mentioned patents, FR 1 395 217 describes a nail varnish applicator having a deformable capsule. The capsule comprises a flexible portion and a rigid portion, the rigid portion including a screw thread enabling it to be screwed onto the neck of a flask. The flexible portion, which may be spherical in shape or a bellows, is secured to a brush and enables the user, by pushing down on the flexible portion, to push down the brush so as to enable it to reach the bottom of the flask and wipe over it so as to be effective in picking up any pigments that have become deposited thereon in order to put them back into suspension.

Applicators including an applicator element having a non-rectilinear longitudinal axis are also known, in particular for applying makeup to the eyelashes or the eyebrows. Given the shape of the applicator element, difficulties can arise when the applicator element is loaded with makeup by being inserted into a receptacle through a wiper. In order to avoid impeding such insertion, the angle formed by the applicator element relative to the stem which supports it must not be too great. Unfortunately, it can be desirable to have an applicator element that is more steeply inclined relative to the stem for ergonomic reasons and/or to make a wider variety of makeup results possible, for example.

SUMMARY AND OBJECTS OF THE INVENTION

A particular object of the invention is to propose a novel applicator, in particular for the lips, the eyelids, the eyebrows, the eyelashes, or the hair, which is more ergonomic and/or which enables new makeup effects to be obtained.

In one of its aspects, the invention provides an applicator comprising:

a handle member;

a stem connected via a hinge to the handle member;

an applicator element disposed at a first end of the stem and configured to apply makeup on keratinous fibers, for example, the eyelashes, the eyebrows, or the hair; and a maneuverable portion enabling the direction in which it points relative to the handle member to be modified, said maneuverable portion extending at least in part between the hinge and a second end of the stem opposite from its first end.

Such an applicator can enable the direction in which the applicator element is pointing relative to the handle member to be modified in use, so as to have a non-zero angle between the axis of the applicator element and an axis of the stem, but without thereby giving rise to difficulty in introducing the applicator into a receptacle containing the makeup for application and provided with a wiper, since such insertion can be performed, for example, while the stem is substantially on the axis of the handle member. When the applicator element is non-rectilinear in shape, the angle of incidence between the applicator element and the handle member can be increased at the time of use without it being necessary to give the applicator element an inclination of a kind that would impede insertion into the receptacle. The fact of inclining the stem relative to the handle member also makes it possible to hold the handle member further away from the face, when making up the eyelashes or the eyebrows, thus making it easier to apply makeup to the eyelashes or the eyebrows with the axis of the stem pointing substantially vertically.

In another of its aspects, the invention provides an applicator comprising:

a handle member;

a stem connected via a hinge to the handle member, the hinge being configurable to prevent perceptible axial and/or lateral displacement at the hinge of the stem relative to the handle member;

an applicator element of any kind disposed at a first end of the stem; and a maneuverable portion enabling the direction in which the stem is pointing relative to the handle member to be modified, said maneuverable portion being capable of extending at least in part between the hinge and a second end of the stem, opposite from the first end.

In the absence of any perceptible axial and/or lateral displacement at the hinge of the stem relative to the handle member can enable the applicator element to be positioned accurately at the location where the makeup is to be applied.

In another of its aspects, the invention provides an applicator comprising:

a handle member;

a stem connected to the handle member via a hinge placed inside the handle member;

an applicator element of any kind disposed at a first end of the stem; and a maneuverable portion enabling the direction in which the stem is pointing relative to the handle member to be modified, said maneuverable portion being capable of extending at least in part between the hinge and a second end of the stem, opposite from its first end.

The fact of placing the hinge inside the handle member can make the applicator more compact and easier to hold in the hand.

In examples of applicators made in accordance with the invention, the handle member may comprise a body provided with an inside thread.

The handle member may comprise a body having the maneuverable portion passing through one end thereof. At said end, the body may have an end wall provided with an opening through which the maneuverable portion passes. This end wall may be generally outwardly convex in shape.

The above-mentioned opening may comprise at least one slot, which slot may serve to guide the movement of the maneuverable portion. The slot may extend, where appropriate, over at least a portion of the side surface of the handle member. By way of example, the opening may have at least two slots of longitudinal axes that are substantially mutually perpendicular, for example. The slot(s) may have edges defining at least one hard point during displacement of the maneuverable portion, e.g. by means of at least one projection. Where appropriate, the hard point may make it easier to hold the maneuverable portion in a predetermined position.

The applicator, e.g. its end wall, may include at least one reference mark, e.g. graduations, enabling the user to identify more easily the direction in which the stem is pointing relative to the handle member.

The maneuverable portion may include a cover configured to cover the handle member at least in part. By way of example, the cover may have a face that is generally concave towards the handle member.

The maneuverable portion may be covered at least in part by a sheath, e.g. a sheath having at least one flexible region. In particular, the flexible region may include a bellows.

The maneuverable portion may be completely covered by the sheath.

The sheath may be entirely flexible, e.g. being made out of an elastomer, e.g. butyl nitrile, ethylene-propylene diene monomer (EPDM), silicone, or latex, this list not being limiting.

The sheath may be applied to the handle member, or in a variant it may be made integrally with the handle member by molding, e.g. by being injected thereover.

The outside shape of the sheath may be axially symmetrical, e.g. presenting a circular cross-section over at least a fraction of its length.

The outside shape of the sheath may privilege deformation thereof in one or more directions. For example, the sheath may thus present a cross-section that is oblong over at least a fraction of its length.

The sheath may have a wall which may be of greater or lesser thickness. For example the sheath may have a wall of thickness, at least in some places, that is of the same order of magnitude as the thickness of a wall of the handle member.

The sheath may also have a wall that is relatively thick, in particular when the sheath is made of a cellular material.

For example, the sheath may comprise a block of foam provided with a recess or at least with a slot in which the second end of the stem is engaged. Such a block may be fixed to one end of the body of the handle member, e.g. by heat-sealing or by adhesive.

The sheath may contribute to sealing the closure of a receptacle onto which the applicator is placed while not in use.

The hinge may include a brake in order to brake the movement of the stem relative to the handle member. The brake may exert braking action regardless of the position of the stem relative to the handle member. In a variant, the brake may alternatively exert braking action only in at least one predetermined position of the stem relative to the handle member.

The hinge may be made in various ways, for example it may allow the stem to move about one axis, two axes, or an infinity of axes.

For example the hinge may comprise a ball-and-socket joint which may have a seat that is rigid or flexible. A rigid seat may make it possible, optionally, to obtain better sealing of the closure of the receptacle by virtue of better contact between a sealing member of the stem and the receptacle, for example.

In a variant, the hinge may comprise a pin, e.g. a metal pin, about which the stem can pivot. The stem may alternatively include a cylindrical portion serving as a pivot.

The hinge may also include at least one flexible wall, e.g. a disk, through which the stem passes, said wall extending between the stem and the handle member. In an embodiment, the hinge comprises at least one block of elastically deformable material, e.g. a foam, through which the stem passes.

The applicator may be configured in such a manner that the stem continues to point in the direction imparted thereto by the user after the user has released the maneuverable portion.

The applicator may alternatively include a resilient return member suitable for returning the stem to point in a predetermined direction when the user releases it, e.g. in order to bring its axis into alignment with that of the handle member. The return member may be constituted, for example, by an element constituting the hinge. The return member may be constituted by a sheath as described above.

The stem may include a sealing member configured to bear in substantially leaktight manner against a surface of a receptacle on which the applicator is fitted when not in use. By way of example, the sealing member may comprise a disk and/or a frustoconical portion.

The applicator element may present a longitudinal axis that is optionally rectilinear.

The applicator element may present a longitudinal axis that forms a non-zero angle with the axis of the stem. This non-zero angle may be formed between the axis of an end portion of the stem adjacent to the applicator element, and the axis of a proximal portion of the applicator element, adjacent to the stem. The non-zero angle may also be formed between the axis of an end portion of the stem adjacent to the applicator element, and the axis of a distal portion of the applicator element, remote from the stem.

The applicator element may be non-rectilinear, or the stem and the applicator element need not extend entirely along a single rectilinear axis. Under such circumstances, and by way of example, the applicator element of the stem may extend in a plane, and the stem may be capable of pivoting only in said plane. The longitudinal axis of the applicator element may also extend out from the pivot plane of the stem.

The applicator element may include bristles and/or teeth extending transversely, e.g. perpendicularly to the longitudinal axis of the applicator element.

The applicator element may comprise a mascara brush, in particular a brush having a core made of two twisted-together branches of a metal wire, the bristles extending substantially radially from the core.

The applicator element may also comprise a comb configured to apply makeup to the keratinous fibers, e.g. the eyelashes or the eyebrows.

The applicator element may be made with serrations, for example.

The applicator element may be made by injecting a plastics material, for example.

In a variant embodiment, the applicator element may comprise a paintbrush type brush, for example a brush for applying nail varnish.

The applicator element may also comprise a foam, a sponge, a felt, or a flocked endpiece, e.g. configured to apply makeup to the lips or the eyelids. The applicator element may be flocked.

The applicator element may be suitable for retaining the makeup by capillarity.

The invention also provides a packaging and applicator device for a cosmetic, the device comprising a receptacle containing the cosmetic and an applicator as defined above.

The applicator may be configured to close the receptacle.

The receptacle may include a wiper. The wiper may serve to return the stem into a position of zero inclination when the applicator is put back on the receptacle.

The receptacle and the applicator may be configured in such a manner that the stem of the applicator is prevented from pivoting relative to the receptacle when the applicator is in place thereon.

Sealed closure of the receptacle may be obtained by sealing means that are situated, on moving along the axis of the hinge, above the hinge, around the hinge, or beneath the hinge.

The invention also provides a method of applying makeup on a portion of the body or the face, in particular on the eyelashes or the eyebrows, the method comprising the following steps:

loading an applicator element with makeup, the applicator element being present at one end of a stem connected in hinged manner to a handle member having an axis; and modifying the direction in which the stem points relative to the handle member by manually exerting thrust oriented transversely to the axis of the handle member on a maneuverable portion adjacent to the second end of the stem opposite from its end carrying the applicator element.

In the event that the applicator element is configured to apply makeup on keratinous fibers, for example the eyelashes and/or the eyebrows, the method may comprise the following steps:

making up the keratinous fibers with the stem in a substantially horizontal position and at a first inclination of the relative to the handle member, said first inclination being zero, for example; and making up the keratinous fibers with the stem substantially vertical and at a second inclination relative to the handle member, the second inclination being different from the first.

BRIEF DESCRIPTION OF THE DRAWINGS

The invention will be better understood on reading the following detailed description of non-limiting embodiments, and on examining the accompanying drawings, in which:

FIGS. 8 to 11 show various examples of other applicators;

FIG. 12 shows a portion of a curved stem;

FIG. 12A is a cross-section of an applicator element including serrations;

DETAILED DESCRIPTION OF THE PREFERRED EMBODIMENTS

Figure 1:
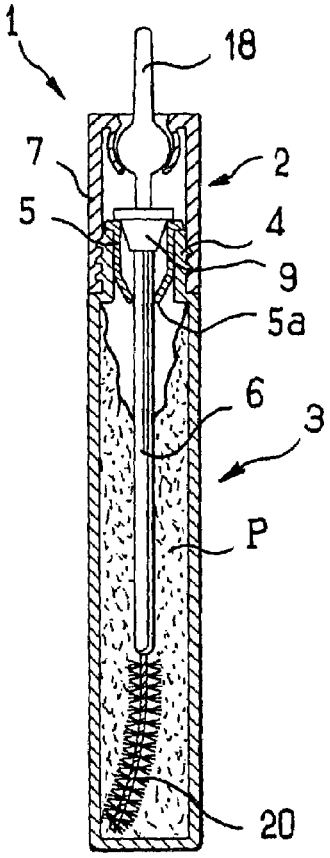
FIG. 1 is a diagrammatic axial section view of a device for applying makeup to the eyelashes or the eyebrows, made in accordance with the invention.
Figure 3:
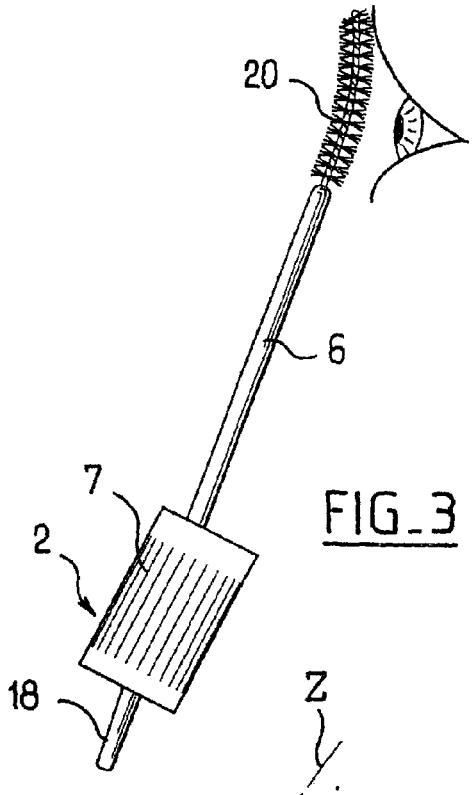
FIG. 3 shows the FIG. 2 applicator being used for making up the eyelashes, the stem being oriented substantially vertically.
Figure 2:
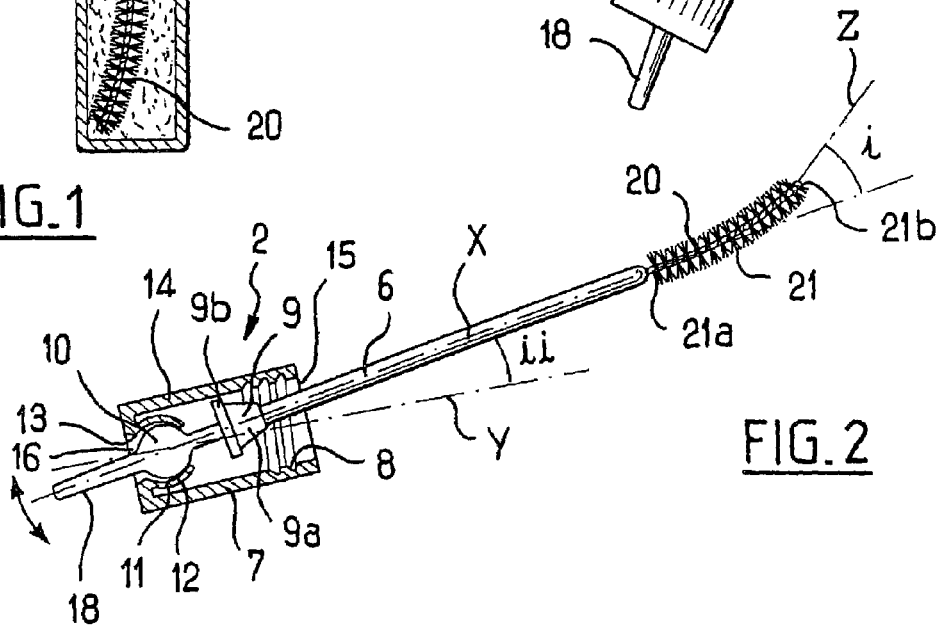
FIG. 2 shows the applicator of the FIG. 1 device in isolation after the stem has been pivoted relative to the handle member.

FIG. 1 shows a device 1 for applying makeup P to the eyelashes or the eyebrows, e.g. mascara, the device comprising an applicator 2 shown on its own in FIGS. 2 and 3 and a receptacle 3 containing the makeup P and on which the applicator 2 can be fixed in substantially leaktight manner when not in use. In conventional manner, the receptacle 3 may have a threaded neck 4, as shown in FIG. 1, with a wiper 5 being fixed inside the threaded neck, the wiper being made out of elastomer, for example, and possibly comprising a flexible lip that is generally conical in shape.

In the example shown, the applicator 2 comprises a rectilinear stem 6 of axis X together with a handle member 7 of axis Y that also serves as a closure cap for the receptacle 3, being provided for this purpose with an inside thread 8 configured to screw onto the neck 4.

The stem 6 has a sealing member 9 configured to cooperate with the opening of the receptacle 3 when the applicator 2 is in place thereon, as can be seen in FIG. 1. By way of example, this sealing member 9 can comprise a frustoconical portion 9*a* fitted at its top end with a collar 9*b* configured to bear against the top edge of the wiper 5. The wiper defines a wiping orifice 5*a* inside the receptacle, which orifice can be circular when the portion of the stem for wiping is circular in section, and it can match the diameter thereof. By way of example, in a variant, the sealing member may comprise no more than the frustoconical portion or a disk, or it may have some other shape, for example it may include a sealing skirt. Particularly when it comprises a disk, the sealing member may include a bead of elastomer material.

The handle member 7 comprises a generally tubular body 14 made of a rigid plastics material, for example, presenting an outside shape that is circularly symmetrical about the axis Y in the example shown, said body 14 defining an opening 15 at axial end enabling it to be engaged on the neck 4 of the receptacle 3, and defining an opening 16 at its opposite end for passing a maneuverable portion 18 of the stem 6, which portion serves to determine the direction in which the stem points relative to the handle member 7.

The stem 6 is connected in hinged manner to the handle member 7 so that the angle ii formed between the axis X of the stem 6 and the axis Y of the handle member 7 can be modified by the user while the applicator 2 is in use, as shown in FIG. 2.

The applicator 2 may have a hinge, e.g. in the form of a ball-and-socket joint, comprising a generally spherical portion 10 formed on the stem 6 together with a socket or seat 11 of complementary shape inside the handle member 7. Such a joint may optionally allow the stem 6 to turn about its own axis X relative to the handle member 7, while preventing perceptible axial and lateral movement of the stem 6 relative to the handle member 7 at the hinge.

In the example, the socket 11 is defined by a wall 12 of the handle member which connects at a top end to an inwardly-directed rim 13 of the body 14.

At its end opposite to the maneuverable portion 18, the stem 6 is provided with an applicator element 20 which may optionally come into contact with the bottom of the receptacle when the applicator is in place, and which is constituted by a mascara brush, for example.

In conventional manner, the brush may comprise a core made of two twisted-together branches of metal wire with bristles projecting substantially radially therefrom.

The direction in which the stem 6 points relative to the handle member 7 can be changed without touching the portion of the stem which is inserted into the receptacle when the applicator is in place thereon, and thus avoiding nay risk of the user dirtying the fingers.

In addition, the maneuverable portion 18 of the stem 6 may enable the user to become aware of a change in the direction in which the applicator element is pointing relative to the handle member while applying makeup, by acting on the maneuverable portion 18.

The stem may be maneuvered using one hand while applying makeup.

Figure 7:
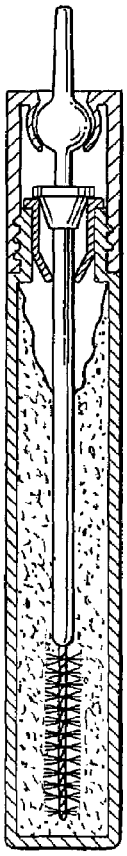
FIG. 7 is a view analogous to FIG. 1 showing a device in which the applicator element is constituted by a brush having a rectilinear longitudinal axis.

The brush may present a core that is not rectilinear, as is the case in the example of FIGS. 1 to 3, or that is rectilinear, as is shown in FIG. 7.

It may be advantageous to ensure that the applicator element 20 and the stem 6 do not both extend along the same straight line, and in particular to ensure that the applicator element presents a longitudinal axis that is curvilinear.

In the example of FIGS. 1 to 3, the brush 20 presents a core that is curved, the proximal portion 21*a* of the core 21 adjacent to the stem being connected thereto substantially along the axis X, with the distal portion 21*b* of the core 21 pointing in a direction Z that forms an angle i with the axis X.

The angle formed between the direction Z and the axis Y of the handle member 7 may correspond to the sum of the angles i and ii, thus making it possible, for example, to apply makeup to the eyelashes while the stem of the applicator is pointing upwards, as shown in FIG. 3.

While making up with the stem of the applicator pointing upwards, the angle between the stem and the handle member may be quite large, so as to make it possible to hold the handle member away from the face, thereby making it easier to apply makeup.

Figure 4:
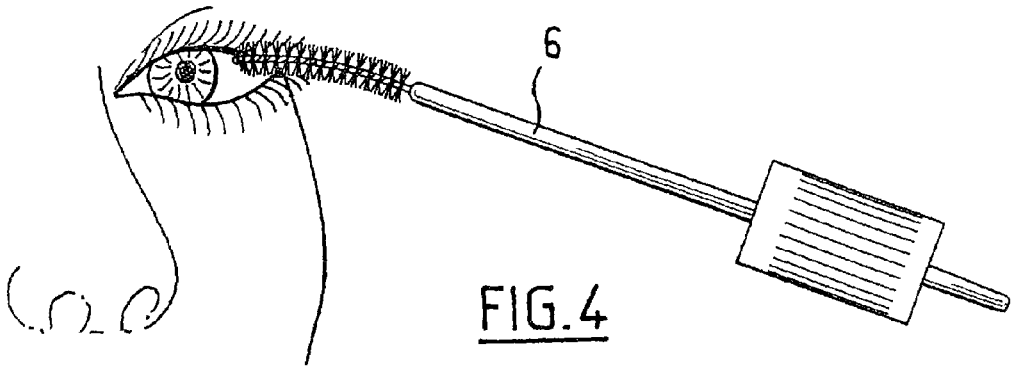
FIG. 4 shows the FIG. 2 applicator being used for making up the eyelashes with the stem being oriented substantially horizontally.

When the applicator is used with the stem substantially horizontal, the direction in which the stem points may be substantially zero relative to the axis of the handle member, for example, as shown in FIG. 4.

The applicator may be configured in such a manner that the stem conserves the direction in which it is caused to point once the maneuverable portion 18 has been released, so that the user does not need to continue applying pressure on the maneuverable portion in order to keep the stem inclined relative to the axis of the handle member.

In a variant, and as described below, the applicator may be configured in such a manner as to return the stem so to point in a predetermined direction relative to the axis of the handle member once the maneuverable portion 18 has been released.

When the applicator is in place on the receptacle, co-operation of the stem and, where appropriate, of the sealing member 9 with the receptacle and in particular with the wiper member 5 may have the effect of preventing the maneuverable portion 18 from tilting perceptibly relative to the handle member, contrary to that which is described, for example, for the device of French patent No. 1 395 217.

Figure 5:
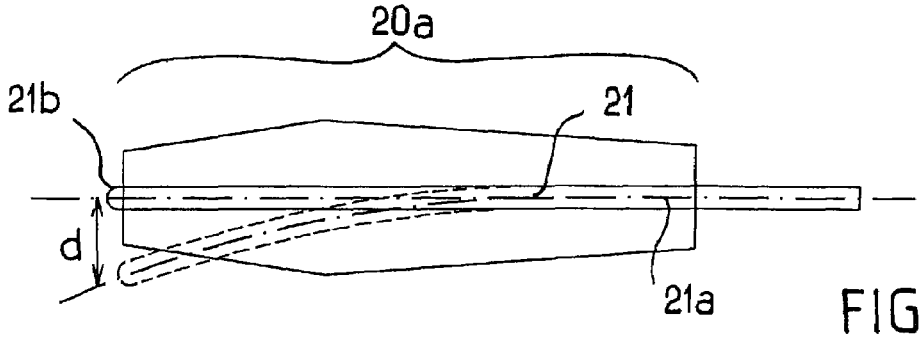
FIGS. 5 and 6 are diagrams showing two examples of brushes suitable for use as the applicator element, the brushes being shown prior to having their cores curved.
Figure 6:
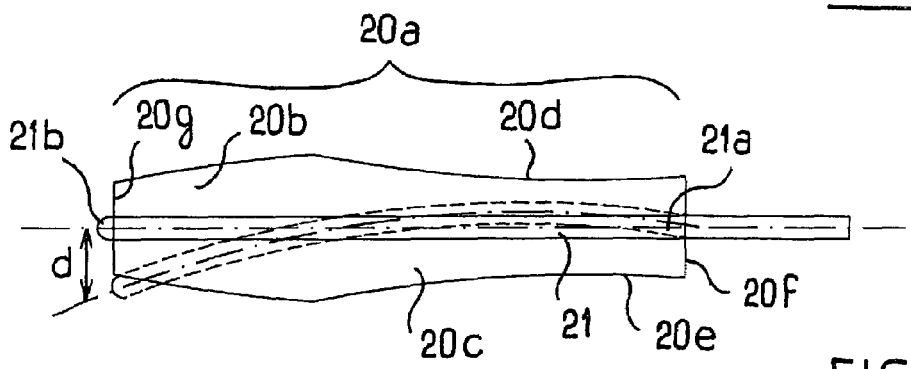

The applicator element 20 at the end of the stem 6 may be constituted in various ways, and in particular by brushes having a core that is off-center and/or a core that is curved, and presenting, prior to the core being curved, a shape of the kind shown for example in FIGS. 5 and 6.

These figures show two brush blanks, prior to the core being curved and prior to the core 21 being implanted in the stem 6.

It can be seen that in each of these two examples the core 21 is entirely rectilinear prior to being implanted in the stem.

Dashed lines show the shape of the core after it has been curved.

In the example of FIG. 5, the blank presents an envelope surface in the form of two truncated cones around its longitudinal axis.

The total length of the portion 20*a* of the brush that carries the bristles is, for example, about 26 millimeters (mm). The largest diameter of the blank may be slightly greater than 7 mm, while the end diameters thereof may be close to 4 mm. The total length of the core 21 may be slightly greater than 35 mm, for example.

The core 21 may be curved while keeping the portion that is implanted in the stem 6 rectilinear so as to give the free portion a radius of curvature that is close to 60 mm, for example.

The free end of the core may be offset from the axis of the rectilinear portion implanted in the stem by a distance d that may be about 4.5 mm, for example.

Prior to the core being curved, the general shape of the blank of FIG. 6 may be substantially a fish-shape with a substantially frustoconical front portion 20*b* and a body 20*c* that is circularly symmetrical, being defined in longitudinal section by two opposite circular edges 20*d* and 20*e* that are outwardly concave, each having a radius of curvature of about 52 mm. The diameter of the brush in the vicinity of its rear end plane 20*f* may be about 7.5 mm, for example, and its diameter in the vicinity of its front end plane 20*g* may be about 5 mm, for example. The blank of FIG. 6 is transformed into the final brush by curving the portion of its core that carries the bristles, so as to have a radius of curvature which is constant as in the example shown, and which is about 53 mm.

The end of the portion of the brush carrying the bristles, adjacent to the portion which is implanted in the stem, may form a small angle as shown in FIG. 6 relative to the axis of the portion implanted in the stem 6. The distance d whereby the free end portion of the core is offset may be about 2.4 mm, for example.

Figure 8:
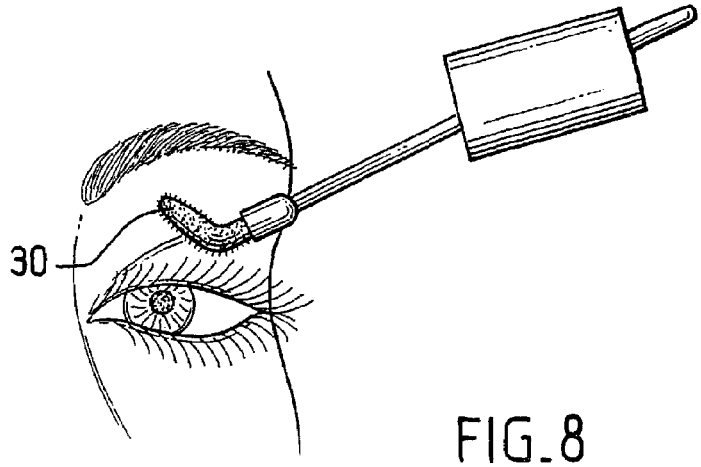

It is also possible to use applicator elements that have a flocked endpiece 30, e.g. for making up an eyelid, as shown in FIG. 8, or a flocked endpiece 40 for making up the lips, as shown in FIG. 9, or a paintbrush type brush 50 for applying varnish to the nails, as shown in FIG. 10. It is also possible to use a comb 60 as shown in FIG. 11. Other examples of non-limiting combs are described in applications EP1 169 941, EP 1 070 465, EP 1 070 468, EP 1 070 467, in particular. It is also possible to use a felt tip or a foam, as shown in FIG. 12.

In this figure, it can be seen that the stem 6 need not be entirely rectilinear and may comprise, for example, a bent portion 6*a*.

The applicator element may include serrations when observed in cross-section, as can be seen in FIG. 12A, and it may be made by injection-molding a plastics material.

The various applicator elements may optionally extend along the same straight line as the stem.

In the example of FIGS. 1 to 3, the maneuverable portion 18 of the stem 6 is made integrally with the remainder of the stem, e.g. by molding a plastics material.

Figure 13:
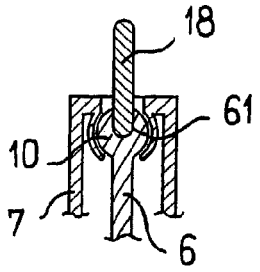
FIGS. 13 to 15 show various examples, amongst others, of how the hinge can be made.

It would not go beyond the ambit of the present invention for the maneuverable portion 18 to be constituted by a separate piece fitted to the remainder of the stem 6, for example by being inserted at one end in a housing 61 of the spherical portion 10, as shown in FIG. 13.

Figure 14:
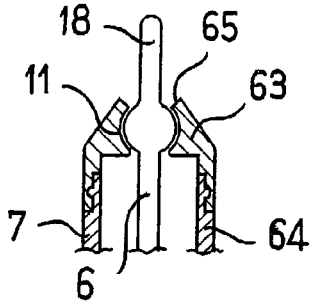

The hinge connecting the stem 6 to the handle member 7 may be constituted by means of a piece that is fitted to the remainder of the handle member 7, as shown in FIG. 14. In this figure, it can be seen that the socket 11 is formed in the piece 63 which is fixed to the remainder 64 of the handle member, e.g. by snap-fastening.

In FIG. 14, it can also be seen that the opening in the handle member 7 through which the maneuverable portion 18 projects may be defined by outwardly-diverging edges 65.

Figure 15:
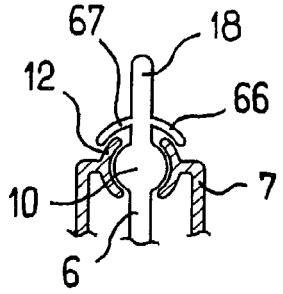

The wall 12 which defines the socket 11 of the ball-and-socket joint may extend, for example, at least in part outside the handle member 7, as shown in FIG. 15.

The maneuverable portion 18 may be provided with a cover 66 serving to cover at least part of the wall 12 of the socket 11 with little or no clearance, the cover 66 optionally presenting a concave face 67 directed towards the wall 12 as in the example shown.

Figure 16:
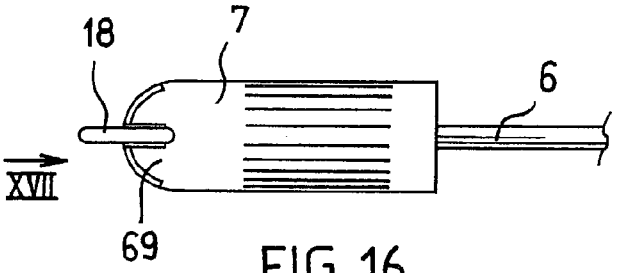
FIG. 16 is a fragmentary side view of an applicator constituting a variant embodiment of the invention.
Figure 17:
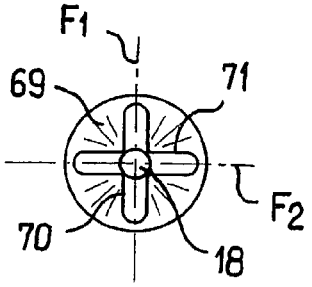
FIG. 17 is an end view seen looking along arrow XVII of FIG. 16.

At one axial end, the handle member 7 may have an end wall 69, as shown in FIG. 16, with one or more slots through which the maneuverable portion 18 passes.

In the example of FIG. 16, the end wall 69 has two slots 70 and 71, of respective axes $F_1$ and $F_2$ that are mutually perpendicular, and of width that corresponds substantially to the diameter of the maneuverable portion 18, said portion be capable of moving in the slots when the stem 6 is inclined relative to the handle member 7.

The presence of the slots 70 and 71 can reduce the range of movements available to the stem 6 relative to the handle member 7 to the directions of the axes $F_1$ and $F_2$.

In the example shown, the end wall 69 is generally outwardly convex. At least one of the above-mentioned slots, for example both slots 70 and 71, may include at least one projection 73, e.g. a pair of projections 73 facing each other so as to create a hard point against passage by the maneuverable portion 18, thereby making it possible to contribute to holding the maneuverable portion 18 in a predetermined position, e.g. in abutment against an axial end of one of the slots.

Figure 18:
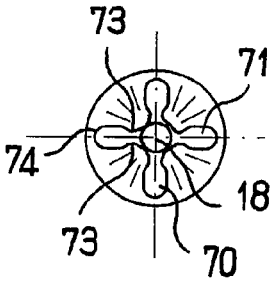
FIGS. 18 and 19 are views analogous to FIG. 17, showing various embodiments.

In the example of FIG. 18, the user can thus bring the maneuverable portion 18 into one of five predefined positions, namely a central position in which the portion 18 lie at the intersection between the slots 70 and 71, and the inclination of the stem 6 relative to the axis Y is substantially zero, and four end positions in each of which the maneuverable portion 18 is in abutment against one of the axial ends of the corresponding slot. Position is changed between the central position and the end positions by going through a hard point associated with the presence of the projections 73.

Figure 19:
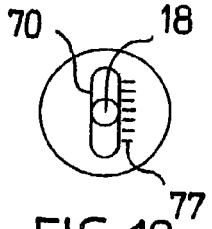

By way of example, if it is desired that the stem 6 should be capable of pivoting about a single axis only, then the handle member 7 need have only one slot 70, as shown in FIG. 19.

When the stem pivots in one plane only, the applicator element may present a longitudinal axis that is curved, extending in said plane.

The handle member may have at least one reference mark 77 enabling the user to identify the position of the maneuverable portion 18 relative to the handle member. For example, the handle member may have a plurality of graduations.

The maneuverable portion 18 may be covered by a sheath, which may be made in various ways. By way of example, the sheath may contribute to sealing the receptacle.

Figure 20:
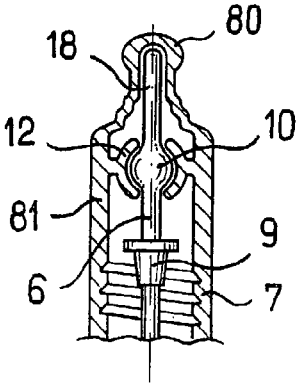
FIGS. 20 to 27 are views showing portions of other examples of applicators.

FIG. 20 shows a sheath 80 made by overmolding an elastomer onto a portion 81 of the body of the handle member 7.

Figure 21:
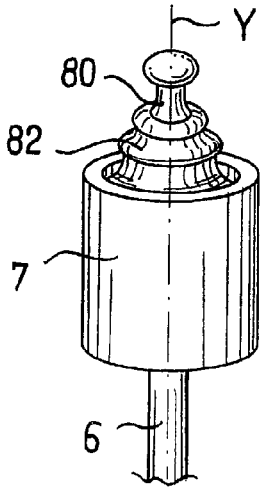

By way of example, the sheath may be made with folds 82 as shown in FIG. 21, the folds 82 constituting, for example, a bellows giving the sheath flexibility in all directions so as to enable the stem 6 to be maneuvered.

In the examples of FIGS. 20 and 21, the outside shape of the sheath is generally circularly symmetrical about the axis Y of the handle member 7, but it would not go beyond the ambit of the present invention to give the sheath a shape that is not circularly symmetrical, optionally for the purpose of defining one or more privileged directions in which the maneuverable portion can be moved.

Figure 22:
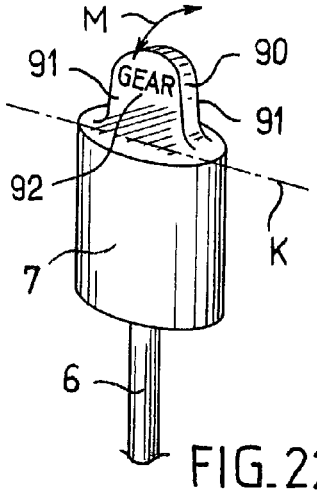

By way of example, FIG. 22 shows a sheath 90 presenting two opposite surfaces 91 that are substantially plane, against which the user can press to change the inclination of the stem 6 relative to the handle member 7.

One of these surfaces 91 may optionally include a message 92 in order to encourage the user to press thereon.

As applies to the sheath shown in FIG. 22, the sheath may be given a shape that serves to limit angular displacement of the stem 6 to displacement about a single axis.

In the example of FIG. 22, the flexibility of the sheath 90 in the displacement direction M of the maneuverable portion 18 that is substantially perpendicular to the surfaces 91 encourages the stem to pivot about an axis K that is substantially parallel to the surfaces 91, whereas the greater stiffness of the sheath 90 in the direction of the axis K tends to prevent pivoting of the stem about an axis perpendicular to the axis K.

The socket of the ball-and-socket joint may be formed by a wall that is integrally formed by being molded out of the same material as the sheath, e.g. for the purpose of braking displacements of the stem by generating more friction.

Figure 23:
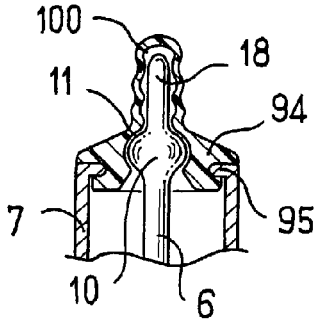

By way of example, FIG. 23 shows an example of a sheath 100 having a bottom portion 94 which is snap-fastened on a rim 95 of the handle member. The bottom portion 94 defines the socket 11 in which the spherical portion 10 of the stem 6 is contained.

The sheath engaged on the maneuverable portion 18 may optionally have no portion that is fixed relative to the handle member.

The maneuverable portion 18 may be free inside the sheath to enable relative displacement, and in particular axial displacement, of the maneuverable portion 18 relative to the sheath while modifying the inclination of the stem.

The maneuverable portion 18 may also not be free relative to the sheath, for example in order to generate constraints tending to return the stem into a rest position in which the axis X coincides substantially with the axis Y.

Where appropriate, the sheath may constitute a resilient return member for returning the stem to a position of zero inclination when at rest.

The sheath may also comprise a block of cellular material fixed to the body of the handle member.

Figure 24:
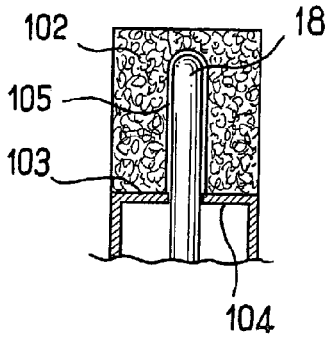

By way of illustration, FIG. 24 shows a sheath constituted by a block 102 of elastically deformable foam fixed via one face 103 to an end wall 104 of the handle member by heat-sealing or by adhesive.

The block 102 includes a recess 105 opening out in the face 103 and in which the maneuverable portion 18 is received.

Figure 25:
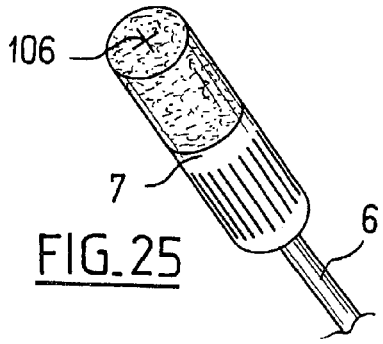

In a variant, the recess 105 may be replaced by one or more slots 106, e.g. two slots in a cross-configuration, as shown in FIG. 25.

Figure 26:
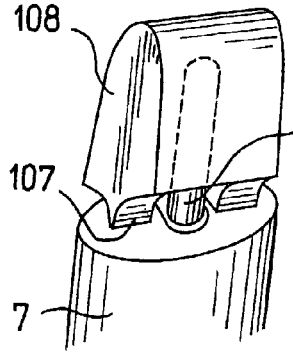

The sheath may also be made out of the same material as the handle member, for example being connected by means of a film hinge to the handle member, as shown in FIG. 26.

This figure shows a sheath 108 made integrally with the handle member 7 by molding, and connected to the handle member via a film hinge 107.

The central region of the film hinge 107 is interrupted so as to allow the maneuverable portion 18 to pass through.

Means other than a ball-and-socket joint may be used for making the hinge between the stem and the handle member.

Figure 27:
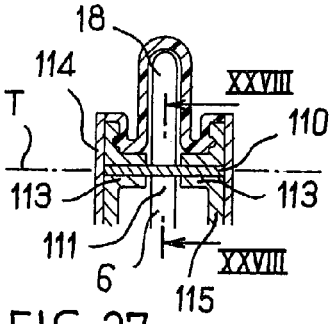
Figure 28:
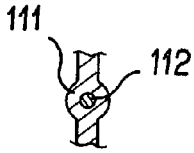
FIG. 28 is a section on XVIII of FIG. 27.

By way of example, FIGS. 27 and 28 show a hinge comprising a pin 110, e.g. a metal pin, having an axis T on which the stem 6 is engaged, which may include, for example, an enlarged portion 111 having plane faces substantially perpendicular to the axis T and pierced by an opening 112 for passing the pin 10. The pin may be fixed in diametrically opposite studs 113 of the handle member. The handle member may include an external covering 114, e.g. made of metal, which is fixed to its body 115 and which also serves to retain the pin 110 in the studs 113.

Figure 29:
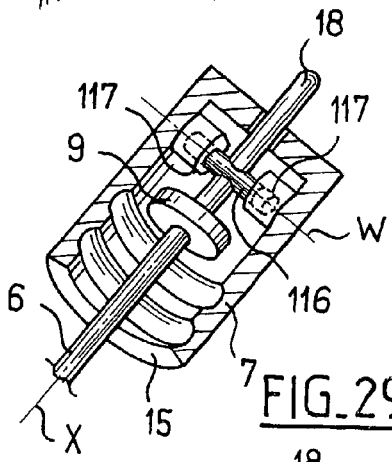
FIGS. 29 to 31 show other examples of hinges.

As shown in FIG. 29, it is also possible to make the hinge of the stem by replacing the spherical portion with a cylindrical portion 116, for example so as to allow the stem to pivot only about the axis W of said cylindrical portion, which axis extends perpendicularly to the axis X of the stem. This cylindrical portion 116 may be received at its axial ends in housings 117 that are open towards the end 15 of the handle member so as to enable the cylindrical portion 116 to be snap-fastened in the housings 117 when the maneuverable portion 18 is inserted into the corresponding opening of the handle member.

The hinge may also be made by using a wall or a block made of deformable material.

Figure 30:
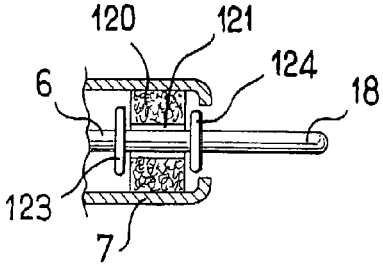

By way of example, FIG. 30 shows a hinge comprising a block 120 of cellular material, e.g. an elastically deformable foam, which is fixed to the inside of the handle member body, e.g. by heat-sealing or by adhesive. The stem 6 passes through an opening 121 in the block 120, e.g. a slot, and it may have portions in relief 123 and 124 disposed on either side of the block 120, these portions in relief being large enough to hold the block 120 between them while the stem 6 is being manipulated by the user in order to change the direction in which it is pointing.

Figure 31:
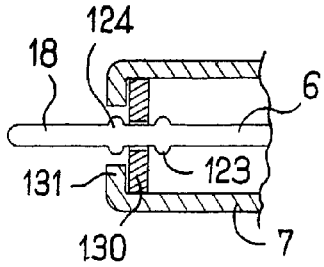

A simple disk 130, e.g. made of elastomer, can also be used, as shown in FIG. 31, the disk being heat-sealed, for example, in a rim 131 of the handle member surrounding the opening through which the maneuverable portion 18 projects.

Figure 32:
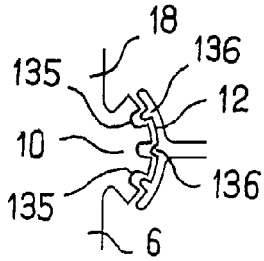
FIG. 32 shows an embodiment of a hinge with serrations.

The spherical portion 10 of the stem engaged in the socket 11 may have portions in relief 135, e.g. serrations as shown in FIG. 32, for co-operating with complementary portions in relief 136 formed in the wall 12 of the socket so as to brake the movement of the stem and/or so as to enable it to be held stationary more easily in one or more predetermined angular positions. In a variant, the portions in relief 135 and 136 may be replaced by at least one bead of elastomer material for generating additional friction between the stem and the handle member.

Naturally, the invention is not limited to the embodiments described above. The characteristics of various embodiments may, for example, be combined with one another in order to constitute new embodiments in accordance with the invention.

Throughout the description, the expression "comprising a" should be understood as being synonymous with "comprising at least one", unless specified to the contrary.

An applicator made in accordance with the invention need not be used with a receptacle into which the applicator is inserted while not in use. The applicator element may be loaded with makeup, for example by being brought into contact with a cake of makeup.

What is claimed is:

1. An applicator comprising:

a handle member being configured to close a receptacle, the handle member including a skirt provided with an inside thread;

a stem connected via a hinge to the handle member so that the stem is movable relative to the handle member, the hinge directly connected to the handle member; and an applicator element disposed at a first end of the stem and configured to apply makeup on keratinous fibers;

the stem including a maneuverable portion enabling the direction in which the stem points relative to the handle member to be modified, said maneuverable portion extending at least in part between the hinge and a second end of the stem opposite from the first end.

2. An applicator according to claim 1, wherein the hinge is configured to prevent at least one of perceptible axial and a perceptible lateral displacement at the hinge of the stem relative to the handle member.

3. An applicator according to claim 1, wherein the handle member comprises a body with the maneuverable portion passing through one end thereof.

4. An applicator according to claim 3, wherein the body of the handle member has an end wall at one end, the end wall being provided with an opening through which the maneuverable portion passes.

5. An applicator according to claim 4, wherein the opening comprises at least one slot.

6. An applicator according to claim 4, wherein the opening comprises at least two slots, the slots having longitudinal axes that extend substantially mutually perpendicularly.

7. An applicator according to claim 5, wherein at least one slot includes at least one edge defining a hard point during displacement of the maneuverable portion.

8. An applicator according to claim 4, wherein the end wall presents a shape that is generally convex towards the outside.

9. An applicator according to claim 1, wherein the maneuverable portion is covered at least in part by a sheath including at least one flexible region.

10. An applicator according to claim 9, wherein the flexible region o the sheath comprises a bellows.

11. An applicator according to claim 9, wherein the maneuverable portion is entirely covered by the sheath.

12. An applicator according to claim 9, wherein the sheath is entirely flexible.

13. An applicator according to claim 9, wherein the sheath is made of elastomer.

14. An applicator according to claim 9, wherein the sheath is fitted to the handle member.

15. An applicator according to claim 9, wherein the sheath is made integrally by molding with the handle member.

16. An applicator according to claim 15, wherein the sheath is connected by a film hinge to the handle member.

17. An applicator according to claim 9, wherein the sheath presents a cross-section that is circular over at least a fraction of its length.

18. An applicator according to claim 9, wherein the sheath presents a cross-section that is oblong over at least a fraction of its length.

19. An applicator according to claim 9, wherein the sheath comprises a block of foam.

20. An applicator according to claim 9, wherein the sheath contributes to sealing a closure of a receptacle on which the applicator is fitted when not in use.

21. An applicator according to claim 1, wherein the applicator is configured in such a manner that the stem continues to point in the direction imparted thereto by a user after the user has released the maneuverable portion.

22. An applicator according to claim 1, wherein the hinge includes a brake for braking the movement of the stem relative to the handle member.

23. An applicator according to claim 22, wherein the brake exerts braking action regardless of the position of the stem relative to the handle member.

24. An applicator according to claim 22, wherein the brake exerts braking action only in at least one predetermined position of the stem relative to the handle member.

25. An applicator according to claim 1, wherein the hinge comprises a ball-and-socket joint.

26. An applicator according to claim 25, wherein said ball-and-socket joint includes a seat and wherein the seat of the joint is rigid.

27. An applicator according to claim 1, wherein the hinge comprises a pin about which the stem can pivot.

28. An applicator according to claim 1, wherein the hinge comprises at least one deformable wall through which the stem passes, the wall extending between the stem and the handle member.

29. An applicator according to claim 28, wherein the deformable wall is a disk.

30. An applicator according to claim 1, wherein the hinge comprises a least one block of elastically deformable material through which the stem passes.

31. An applicator according to claim 30, wherein the elastically deformable material is a foam.

32. An applicator according to claim 1, wherein the stem includes a cylindrical portion acting as a pivot.

33. An applicator according to claim 1, wherein the applicator element has a longitudinal axis that is not rectilinear.

34. An applicator according to claim 1, wherein the applicator element has a longitudinal axis that forms a non-zero angle with an axis of the stem.

35. An applicator according to claim 1, wherein the applicator element includes bristles or teeth extending transversely to a longitudinal axis of the applicator element.

36. An applicator according to claim 35, wherein the applicator element is a mascara brush.

37. An applicator according to claim 35, wherein the applicator element comprises a comb configured to apply makeup to at least one of the eyelashes and the eyebrows.

38. A device for packaging and applying a cosmetic, the device comprising a receptacle comprising the cosmetic and an applicator as defined in claim 1.

39. A device according to claim 38, wherein the applicator is configured to close the receptacle.

40. A device according to claim 38, wherein the receptacle and the applicator are configured in such a manner that the stem of the applicator is prevented from pivoting relative to the receptacle when the applicator is in place thereon.

41. An applicator according to claim 1, wherein the stem pivots in at least two orthogonal directions relative to each other from a central axis of the handle member.

42. An applicator comprising:

a handle member;

a stem connected via a hinge to the handle member so that the stem is movable relative to the handle member, the hinge directly connected to the handle member:

an applicator element disposed at a first end of the stem and configured to apply makeup on keratinous fibers; and at least one reference mark enabling a user to identify the direction in which the stem is pointing relative to the handle member;

the stem including a maneuverable portion enabling the direction in which the stem points relative to the handle member to be modified, said maneuverable portion extending at least in part between the hinge and a second end of the stem opposite from the first end.

43. An applicator according to claim 42, wherein the at least one reference mark is a graduation.

44. An applicator comprising:

a handle member:

a stem connected via a hinge to the handle member so that the stem is movable relative to the handle member, the hinge directly connected to the handle member; and an applicator element disposed at a first end of the stem and configured to apply makeup on keratinous fibers;

the stem including a maneuverable portion enabling the direction in which the stem points relative to the handle member to be modified, said maneuverable portion extending at least in part between the hinge and a second end of the stem opposite from the first end, and the maneuverable portion including a cover configured to cover at least part of the handle member.

45. An applicator according to claim 44, wherein the cover presents a face that is generally concave towards a body of the handle member.

46. An applicator comprising:

a handle member;

a stem connected via a hinge to the handle member so that the stem is movable relative to the handle member, the hinge directly connected to the handle member; and an applicator element disposed at a first end of the stem and configured to apply makeup on keratinous fibers;

the stem including a maneuverable portion enabling the direction in which the stem points relative to the handle member to be modified, said maneuverable portion extending at least in part between the hinge and a second end of the stem opposite from the first end, and the stem including a sealing member configured to cooperate in substantially leaktight manner with a surface of a receptacle on which the applicator is fitted when not in use.

47. A device for packaging and applying a cosmetic, the device comprising:

a receptacle including the cosmetic and an applicator, the applicator including:

a handle member:

a stem connected via a hinge to the handle member so that the stem is movable relative to the handle member, the hinge directly connected to the handle member; and an applicator element disposed at a first end of the stem and configured to apply makeup on keratinous fibers;

the stem including a maneuverable portion enabling the direction in which the stem points relative to the handle member to be modified, said maneuverable portion extending at least in part between the hinge and a second end of the stem opposite from the first end, and the receptacle including a wiper.

* * * * *